US009797216B2

(12) United States Patent
Rosa et al.

(10) Patent No.: US 9,797,216 B2
(45) Date of Patent: Oct. 24, 2017

(54) ELECTROMAGNETIC ACTUATOR FOR A BLOWOUT PREVENTER

(71) Applicant: SHELL OIL COMPANY, Houston, TX (US)

(72) Inventors: Wilfredo Rosa, Katy, TX (US); Curtis Len Wilie, Alvin, TX (US)

(73) Assignee: SHELL OIL COMPANY, Houston, TX (US)

( * ) Notice: Subject to any disclaimer, the term of this patent is extended or adjusted under 35 U.S.C. 154(b) by 354 days.

(21) Appl. No.: 14/409,406

(22) PCT Filed: Jun. 18, 2013

(86) PCT No.: PCT/US2013/046266
§ 371 (c)(1),
(2) Date: Dec. 18, 2014

(87) PCT Pub. No.: WO2013/192154
PCT Pub. Date: Dec. 27, 2013

(65) Prior Publication Data

US 2015/0198004 A1 Jul. 16, 2015

Related U.S. Application Data

(60) Provisional application No. 61/661,918, filed on Jun. 20, 2012.

(51) Int. Cl.
*B23D 21/00* (2006.01)
*E21B 33/06* (2006.01)

(52) U.S. Cl.
CPC ..... *E21B 33/063* (2013.01); *E21B 33/062* (2013.01)

(58) Field of Classification Search
CPC ..... B23D 21/006; B23D 31/00; B23D 33/06–33/064; B23D 21/003; B23D 21/00
See application file for complete search history.

(56) References Cited

U.S. PATENT DOCUMENTS

| | | | | |
|---|---|---|---|---|
| 4,081,027 | A | 3/1978 | Nguyen | |
| 4,537,250 | A | 8/1985 | Troxell | |
| 5,316,087 | A | 5/1994 | Manke et al. | |
| 5,440,183 | A * | 8/1995 | Denne | F15B 15/00 310/12.26 |
| 6,013,959 | A | 1/2000 | Hoppie | |
| 7,338,027 | B1 * | 3/2008 | Whitby | E21B 33/062 166/85.4 |

(Continued)

OTHER PUBLICATIONS

PCT International Search Report, Application No. PCT/US2013/046266 dated Sep. 6, 2013.

*Primary Examiner* — Kipp Wallace

(57) ABSTRACT

A blowout preventer comprising: a body comprising a bore therethrough; a cavity disposed through the body and intersecting the bore; first and second closure members moveably disposed within the cavity on opposite sides of the bore; a first rod having a length and comprising a first end coupled to the first closure member; a second rod having a length and comprising a first end coupled to the second closure member; a first glider assembly wherein a second end of the first rod is at least partially disposed within the first glider assembly; and a second glider assembly wherein a second end of the second rod is at least partially disposed within the second glider assembly.

7 Claims, 3 Drawing Sheets

(56) References Cited

U.S. PATENT DOCUMENTS

| | | | | |
|---|---|---|---|---|
| 2006/0090899 | A1 | 5/2006 | Gass | |
| 2008/0053662 | A1* | 3/2008 | Williamson | E21B 34/066 166/381 |
| 2011/0297394 | A1* | 12/2011 | VanDelden | E21B 33/06 166/373 |

* cited by examiner

ELECTROMAGNETIC ACTUATOR FOR A BLOWOUT PREVENTER

CROSS REFERENCE TO RELATED APPLICATIONS

The present application is a National Stage (§371) of International Application No. PCT/US2013/046266, filed Jun. 18, 2013, which claims priority from U.S. Provisional Application No. 61/661,918, filed Jun. 20, 2012, the disclosures of each of which are hereby incorporated by reference in their entirety.

FIELD OF THE INVENTION

The invention relates to an oilfield closing device, also known as a blowout preventer (BOP) and an electromagnetic actuator for closing the BOP.

BACKGROUND

Considerable safety measures are required when drilling for oil and gas on-shore and off-shore, and one of the key safety measures is the use of blowout preventers. BOPs are basically large valves that close, isolate and seal the wellbore to prevent the discharge of pressurized oil and gas from the well during a kick or other event. One type of BOP used extensively is a ram-type BOP. This type of BOP uses two opposing rams that close by moving together to either close around the pipe or to cut through the pipe and seal the wellbore.

The blowout preventers are typically operated using pressurized hydraulic fluid to control the position of the rams. Most BOPs are coupled to a fluid pump or another source of pressurized hydraulic fluid. In most applications, multiple BOPs are combined to form a BOP stack, and this may include the use of multiple types of BOPs. In some applications, several hundred gallons of pressurized hydraulic fluid may have to be stored at the BOP to be able to operate the BOP.

U.S. Pat. No. 7,338,027 describes a ram-type blowout preventer that is designed to use less fluid to address the problems of storing and pressurizing large quantities of hydraulic fluid. The patent provides an overview of a BOP and the method of its operation.

Conventional hydraulic blowout preventers require a considerable amount of space, mainly due to the hydraulic storage tanks and the associated pressurized accumulators that are used as the driving force for the hydraulic fluid. Further, these systems are heavy and become more difficult to operate and less efficient when used in deepwater subsea conditions because of the hydrostatic pressure of the seawater. In addition, hydraulic blowout preventers can take some time to close depending on the control scheme being used to close the blowout preventer. It is desirable to provide a blowout preventer that does not have these disadvantages.

SUMMARY OF THE INVENTION

This invention provides a blowout preventer comprising: a body comprising a bore therethrough; a cavity disposed through the body and intersecting the bore; first and second closure members moveably disposed within the cavity on opposite sides of the bore; a first rod having a length and comprising a first end coupled to the first closure member; a second rod having a length and comprising a first end coupled to the second closure member; a first glider assembly wherein a second end of the first rod is at least partially disposed within the first glider assembly; and a second glider assembly wherein a second end of the second rod is at least partially disposed within the second glider assembly wherein the first and second rods have magnets along at least a portion of the length of each rod; the first and second glider assemblies are located on opposite sides of the bore; and the first and second glider assemblies each comprise means for generating an electromagnetic field.

The invention further provides a method of sealing a wellbore and stopping the flow of hydrocarbons therethrough comprising: providing a blowout preventer in the wellbore, the blowout preventer comprising: a body comprising a bore therethrough that is aligned with the wellbore; a cavity disposed through the body and intersecting the bore; first and second closure members moveably disposed within the cavity on opposite sides of the bore; a first rod having a length and comprising a first end coupled to the first closure member; a second rod having a length and comprising a first end coupled to the second closure member; a first glider assembly wherein a second end of the first rod is at least partially disposed within the first glider assembly; and a second glider assembly wherein a second end of the second rod is at least partially disposed within the second glider assembly; wherein the first and second rods have magnets along at least a portion of the length of each rod; the first and second glider assemblies are located on opposite sides of the bore; and the first and second glider assemblies each comprise means for generating an electromagnetic field; and generating an electromagnetic field in the first and second glider assemblies that interacts with the magnets located along the first and second rods causing the rods and the closure members attached to the rods to move towards the center of the bore such that the first closure member contacts the second closure member, sealing the bore.

DETAILED DESCRIPTION

The electromagnetic actuated blowout preventers described herein overcome these disadvantages and provide a more compact, lighter and more efficient blowout preventer. These blowout preventers will be described in more detail with respect to the figures, although it is noted that these figures depict one of many possible embodiments for use of an electromagnetic actuated blowout preventer.

Figure 1:
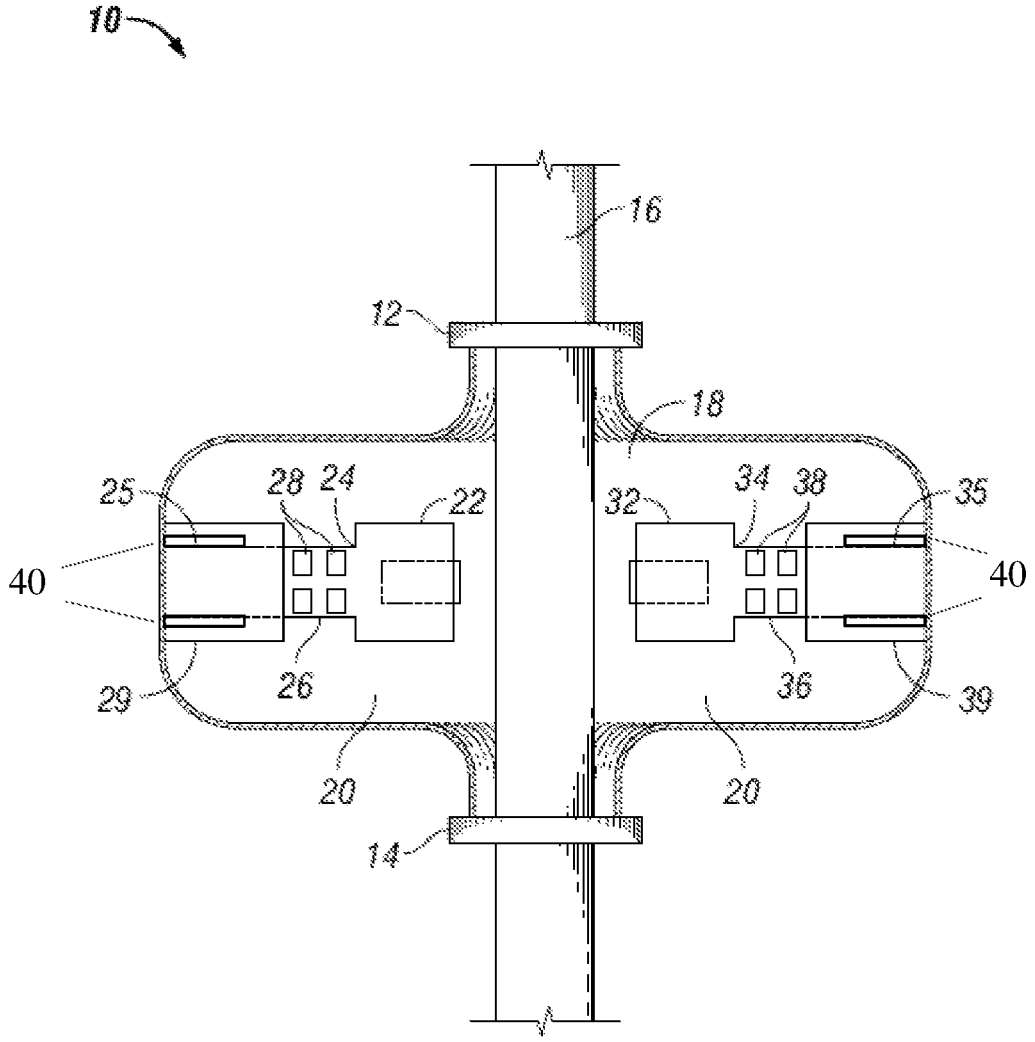
FIG. 1 depicts an embodiment of the blowout preventer with the rams in open position.

FIG. 1 depicts an embodiment of a blowout preventer according to the invention. The blowout preventer is shown in the open position. The blowout preventer 10 may be connected at the top 12 and bottom 14 to tubular pipe, to the wellbore or to additional blowout preventers to form a BOP stack (not shown). The tubular 16 passes through the blowout preventer bore 18 and may be a drill string, riser for the production of oil and gas from the wellbore or any other tubular used in drilling, completion, workover, production or other steps in producing oil and gas from subterranean formations.

The blowout preventer may be located at or near the seafloor or on a drilling or production vessel located at or near the surface of the sea for subsea wells, or on land for on-shore applications.

The blowout preventer comprises a cavity 20 that is shown here as a horizontal cavity that extends from one side of the blowout preventer to the other side. A first closure member 22 is located to the left of the bore and a second closure member 32 is located to the right of the bore. These closure members are typically referred to as rams, and these can be pipe rams, blind rams, shear rams or blind shear rams. Pipe rams generally have a half circle opening in the edge nearest the bore such that when the pipe rams move toward the tubular 16, they contact each other and form a seal around the tubular. Pipe rams only restrict flow in the annulus around the tubular, but not flow inside of the tubular. Blind rams have no openings for tubing, and these are used to close off a well when the well does not contain any tubing or pipe. Shear rams generally have a hardened steel blade that is designed to cut through the tubular 16. Blind shear rams are intended to seal a wellbore even when the bore contains a tubular by cutting through the tubular as the rams close off the well. The electromagnetic actuator can be used with any of these types of closure members.

The first closure member is coupled to the first end 24 of a first rod 26. The first rod has magnets 28, preferably permanent magnets, along the length of the rod or at least along a portion of the length of the rod. The second closure member is coupled to the first end 34 of a second rod 36. The second rod has magnets 38, preferably permanent magnets, along the length of the rod or at least along a portion of the length of the rod.

The magnets are preferably positioned such that the magnetic fields of the magnets alternate along the length of the rod. For example, a line of magnets may be positioned such that the magnetic field is in one direction and a second line of magnets may be positioned such that the magnetic field is in the opposite direction. One embodiment of this is to use the same type of magnet, but to alternate which side of the magnet faces outward from the rod. The rod may have a cross sectional area that is circular or one of many shapes, including triangular, square, pentagonal, hexagonal, heptagonal, or octagonal. Shapes with flat sides may be easier to construct as the magnets can be attached to a flat surface as opposed to a curved surface.

Each of the rods is situated such that a second end of the rod is at least partially disposed within a glider assembly. The second end 25 of the first rod is disposed at least partially within a first glider assembly 29. The second end 35 of the second rod is disposed at least partially within a second glider assembly 39.

The first and second glider assemblies comprise means for generating an electromagnetic field. The electromagnetic field may be generated by coils of wire positioned along the length of the glider assembly. The direction of the electromagnetic field is determined by the direction in which the current flows through the wire. In addition, ferromagnetic or other material can be positioned within the coil to improve the strength of the magnetic field produced by the coil. Alternatively, a system similar to and using the same principles as a rail gun could be used to start movement of the rod. In this embodiment, the second ends 25, 35 of each of the first and second rods 26, 36 could be in contact with separate sets of conductive rails 40. When a large enough current is applied to the rails 40, the rods 26, 36 would be forced towards the bore of the BOP.

Figure 2:
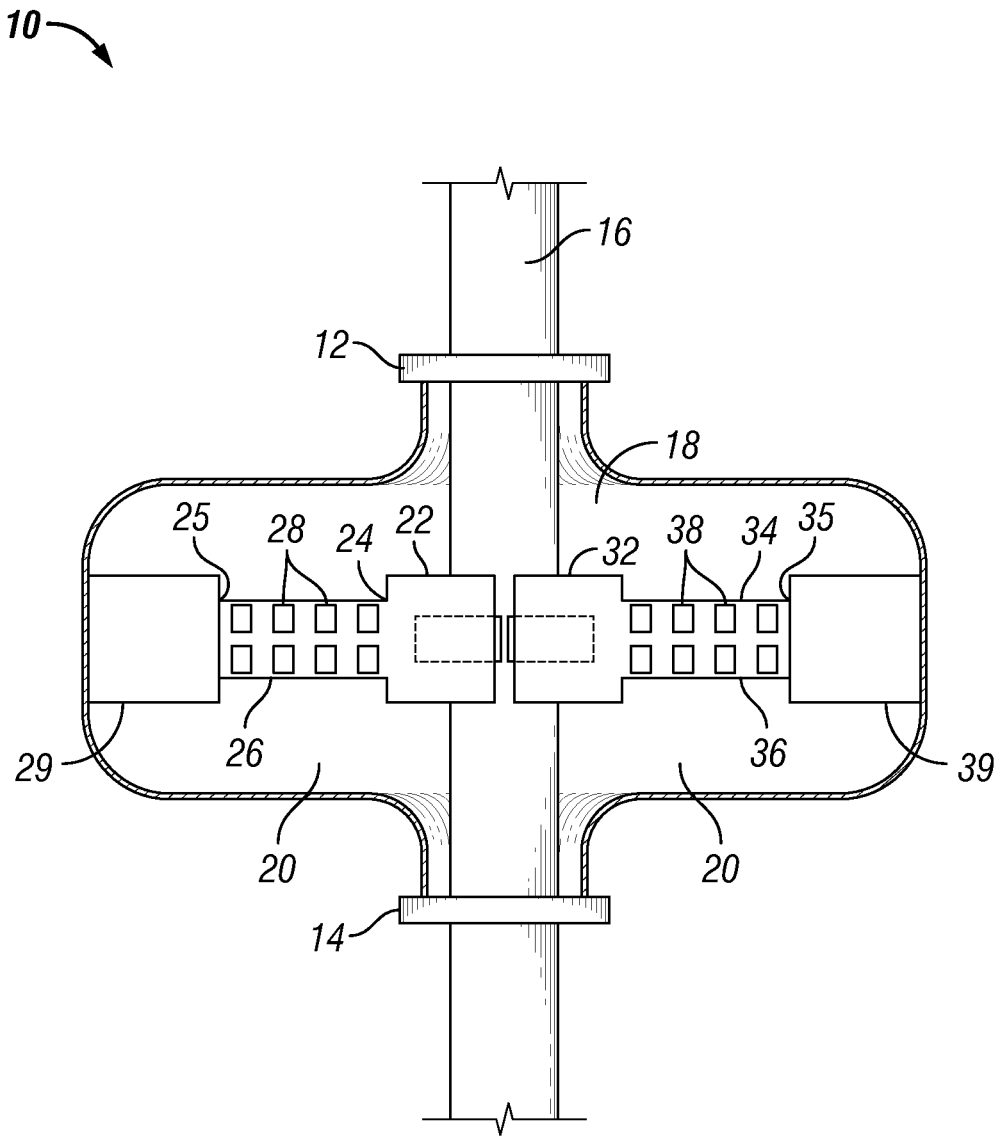
FIG. 2 depicts an embodiment of the blowout preventer with the rams in closed position.

FIG. 2 depicts the blowout preventer in the closed position. The elements of the system are numbered the same as in FIG. 1. This figure shows the closure members, in this figure, pipe rams, closed around tubular 16 to seal the annular space of the wellbore surrounding the tubular. The rod is still at least partially disposed within the glider assembly even when the closure members are closed. This allows for the BOP to be opened and to maintain the stability of the rods while the BOP is closed.

Figure 3:
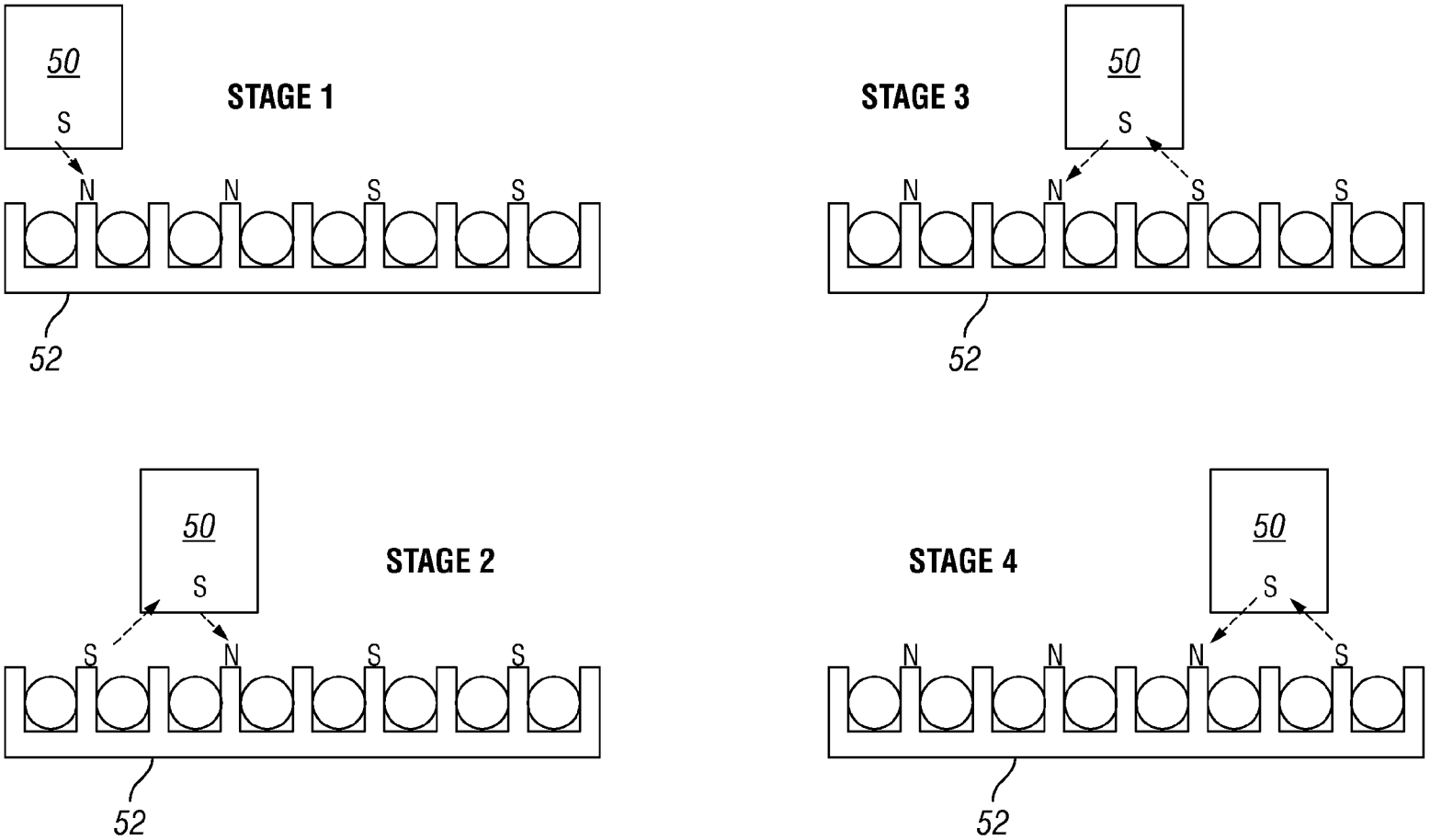
FIG. 3 depicts a schematic view of the operation of the system as the blowout preventer is closed.

The method of operation to close the blowout preventer will be further described with respect to FIG. 3, which shows a simplified view of the system to illustrate its operation. FIG. 3 shows one permanent magnet 50, as would be found on the rod with the south pole facing towards a part of the glider assembly 52. The four stages shown in the figure show how the magnetic field of the glider assembly is changed to accelerate the rod and then decelerate the rod.

Stage 1 shows the acceleration of the rod as the magnet on the rod is attracted to the electromagnet on the glider assembly. In stage 2, the magnet on the rod is attracted to the next electromagnet while being repelled by the electromagnet that it just passed. The current in the respective coils of wire is altered to alter the magnetic field produced. In stage 3, the rod begins to decelerate due to the attractive force of the magnets it just passed along with the repulsive force of the magnets ahead of it. This continues in stage 4 until the magnets (and the rod) come to a stop. This occurs at the point where the first and second closure members have come into contact to seal the wellbore.

Depending on where the magnets are positioned along the rod, current is only applied to the electromagnets that are in the vicinity of the permanent magnets on the rod. If magnets are located along the entire length of the rod then the operation as shown in FIG. 3 will be carried out sequentially for each magnet as it passes the electromagnets on the glider assembly. If magnets are only located along a portion of the length of the rod then the electromagnets will only be powered when the magnets on the rod are nearby.

As the electromagnetic fields are produced the rod will begin to move through the glider assembly and will cause the closure member to close with sufficient force to overcome the wellbore pressure and in the case of shear rams to cut through the pipe and withstand the wellbore pressure. Once the closure member comes into contact with the other closure member, a locking member will engage thus locking the closure members and/or the rods into place to prevent the BOP from opening even if the electrical current to the electromagnets is turned off.

One embodiment of this blowout preventer also comprises a device or system to aid in initiating movement of the shaft. Depending on the design of the system, it may take some time to generate a sufficient electromagnetic field to accelerate the rod. There are many possible methods or devices to help start the system, and then the force to continue to move the rod would be a result of the electromagnetic field and the interaction with the magnets on the rod.

Possible systems for initiating movement of the rod include the use of explosives or propellants. Small explosives or propellants could be placed outside the second end of the rods and when detonated would provide sufficient force to start the rod moving. Pistons could optionally be placed on the ends of the rod to help absorb the force of the explosives or propellants.

The invention claimed is:

1. A blowout preventer comprising:

a. a body comprising a bore therethrough;

b. a cavity disposed through the body and intersecting the bore;

c. first and second closure members moveably disposed within the cavity on opposite sides of the bore;

d. a first rod having a length and comprising a first end coupled to the first closure member;

e. a second rod having a length and comprising a first end coupled to the second closure member;

f. a first glider assembly wherein a second end of the first rod is at least partially disposed within the first glider assembly; and g. a second glider assembly wherein a second end of the second rod is at least partially disposed within the second glider assembly;

wherein the first and second rods have magnets along at least a portion of the length of each rod; the first and second glider assemblies are located on opposite sides of the bore; the first and second glider assemblies each comprise means for generating an electromagnetic field; the second end of the first and second rods is connected to separate sets of conductive rails.

2. The blowout preventer of claim 1 where the closure members are pipe rams, shear rams or blind shear rams.

3. The blowout preventer of claim 1 wherein the first and second glider assemblies each comprise a coil that is connected to a power source for applying electric current to the coil to produce an electromagnetic field.

4. A method of sealing a wellbore and stopping the flow of hydrocarbons therethrough comprising:

a. providing a blowout preventer in the wellbore, the blowout preventer comprising:

i. a body comprising a bore therethrough that is aligned with the wellbore;

ii. a cavity disposed through the body and intersecting the bore;

iii. first and second closure members moveably disposed within the cavity on opposite sides of the bore;

iv. a first rod having a length and comprising a first end coupled to the first closure member;

v. a second rod having a length and comprising a first end coupled to the second closure member;

vi. a first glider assembly wherein a second end of the first rod is at least partially disposed within the first glider assembly; and vii. a second glider assembly wherein a second end of the second rod is at least partially disposed within the second glider assembly;

wherein the first and second rods have magnets along at least a portion of the length of each rod; the first and second glider assemblies are located on opposite sides of the bore; the first and second glider assemblies each comprise means for generating an electromagnetic field; and the second end of the first and second rods is connected to separate sets of conductive rails that are operated as a railgun to propel the first and second rods toward the center of the bore; and b. generating an electromagnetic field in the first and second glider assemblies that interacts with the magnets located along the first and second rods causing the rods and the closure members attached to the rods to move towards the center of the bore such that the first closure member contacts the second closure member, sealing the bore.

5. The method of claim 4 wherein the first and second glider assemblies comprise coils that are connected to an electric power source to generate an electromagnetic field.

6. The method of claim 4 further comprising a method of initiating movement of the closure members or the connected rods that does not comprise the use of an electromagnetic field.

7. The method of claim 6 wherein the method of initiating movement may comprise the use of explosives or propellants.

* * * * *